US005461460A

United States Patent [19]

Lee

[11] Patent Number: 5,461,460

[45] Date of Patent: Oct. 24, 1995

[54] METHOD FOR ELIMINATING A PAPER JAM IN AN IMAGE FORMING SYSTEM

[75] Inventor: Bong-Gi Lee, Seoul, Rep. of Korea

[73] Assignee: SamSung Electronics Co., Ltd., Suwon, Rep. of Korea

[21] Appl. No.: 248,975

[22] Filed: May 24, 1994

[30] Foreign Application Priority Data

May 24, 1993 [KR] Rep. of Korea ..... 8997/1993

[51] Int. Cl.[6] ..... G03G 21/00

[52] U.S. Cl. ..... 355/207; 355/316

[58] Field of Search ..... 355/204–208, 355/308, 309, 316, 321; 271/258, 259

[56] References Cited

U.S. PATENT DOCUMENTS

| | | | |
|---|---|---|---|
| 4,231,567 | 11/1980 | Ziehm | 271/259 |
| 4,247,193 | 1/1981 | Kaneko et al. | 355/206 |
| 4,497,569 | 2/1985 | Booth, Sr. | 355/206 |
| 4,540,274 | 9/1985 | Abuyama | 355/206 |
| 4,627,711 | 12/1986 | Schron | 355/208 |
| 4,733,281 | 3/1988 | Yoshinaga et al. | 355/208 |
| 4,750,020 | 6/1988 | Ishizu et al. | 355/205 |
| 4,878,428 | 11/1989 | Watarai | 101/484 |
| 5,030,991 | 7/1991 | Zaitsu et al. | 355/207 |
| 5,257,070 | 10/1993 | Miller | 355/207 |

*Primary Examiner*—William J. Royer
*Attorney, Agent, or Firm*—Robert E. Bushnell

[57] ABSTRACT

In an image forming system having fixing rollers for affixing developing material (toner) onto the surface of paper, a paper jam elimination method is disclosed. The method prevents toner stains within the system's interior portions by providing a complete transfer and fixation of toner onto the paper's surface. The method includes the steps of: detecting a paper jam, heating the fixing rollers to a predetermined temperature in response to establishment of a paper jam elimination mode, and eliminating the paper jam after heating the fixing rollers to the predetermined temperature.

21 Claims, 4 Drawing Sheets

METHOD FOR ELIMINATING A PAPER JAM IN AN IMAGE FORMING SYSTEM

BACKGROUND OF THE INVENTION

The present invention relates to an image forming system for recording images using electrophotographic developing processes, and more particularly, to a method for automatically eliminating a paper jam.

Electrophotographic developing processes are widely used in copiers, printers, facsimile machines and other instruments to generate an image corresponding to an electrical signal. An example of an electrophotographic developing printer is a laser beam printer (hereinafter referred to as "LBP"). The general structure of a LBP using the electrophotographic developing process is disclosed in detail in U.S. Pat. No. 5,002,266 entitled "Sheet Feed Apparatus for Image Forming System" issued to Kikuchi et al. on 26 Mar. 1991.

When a paper jam occurs within an image forming system, elimination of the jam is often enabled through rotation of drive rollers within the system. In U.S. Pat. No. 5,257,070 entitled Selective Control Of Distributed Drives To Maintain Interdocument Gap During Jam Recovery Purge, issued to Miller et al. discloses a scheme where the paper path is divided into a plurality of zones. During a paper jam, copy sheets are systematically purged from various zones of the paper path in a predetermined order based upon the particular disposition of the copy sheets in the paper path zones. Many conventional devices utilize paper jam eliminating methods similar to Miller et al. With these methods, however, there can be problems with toner contamination. That is, while jammed paper is ejected from the system, developing material, such as toner, can contaminate the interior of the image forming system.

The problem of toner contamination has been recognized in U.S. Pat. No. 4,878,428 entitled Control Method Of Transporting A Cut Sheet In A Printing Station And Apparatus Using The Same, issued to Watarai. This art discloses steps of: detecting a paper jam within a feeding unit, stopping operation of a transfer mechanism within the feeding unit, continuing to operate other transfer mechanism within the printer until all unjammed paper is ejected, and then stopping operation of all transfer mechanism. Although Watari '428 purports to avoid the toner contamination problem discussed above, it has a disadvantage of not promptly ejecting the paper jammed within the feeding unit. Accordingly, toner contamination is avoided, but a paper jam elimination problem still exists.

SUMMARY OF THE INVENTION

Therefore, it is an object of the present invention to provide an improved method for eliminating a paper jam from an image forming system.

It is another object to provide a method for eliminating a paper jam from an image forming system without contaminating an interior portion of the system with developing material, such as toner.

It is still another object to provide a paper jam eliminating method that effectively ejects all paper from a paper conveyance path within an image forming system.

It is yet another object to provide a method for eliminating a paper jam from an image forming system that is easily implemented by a user.

To achieve these and other objects, the present invention contemplates activating a printing system, making a first determination of whether a paper jam has occurred, establishing a paper jam elimination mode if said first determination indicates that the paper jam has occurred, heating fixing rollers to a predetermined temperature in response to establishment of the paper jam elimination mode, and eliminating the paper jam detected during said first determination after heating the fixing rollers. Alternatively, if said first determination indicates that the paper jam has not occurred, the present invention contemplates starting an engine driving motor for powering the printing system, making a second determination of whether a paper jam has occurred, eliminating the paper jam, stopping the engine driving motor and establishing a stand-by mode if said second determination indicates that the paper jam has occurred, and stopping the engine driving motor and establishing the stand-by mode if said second determination indicates that the paper jam has not occurred.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
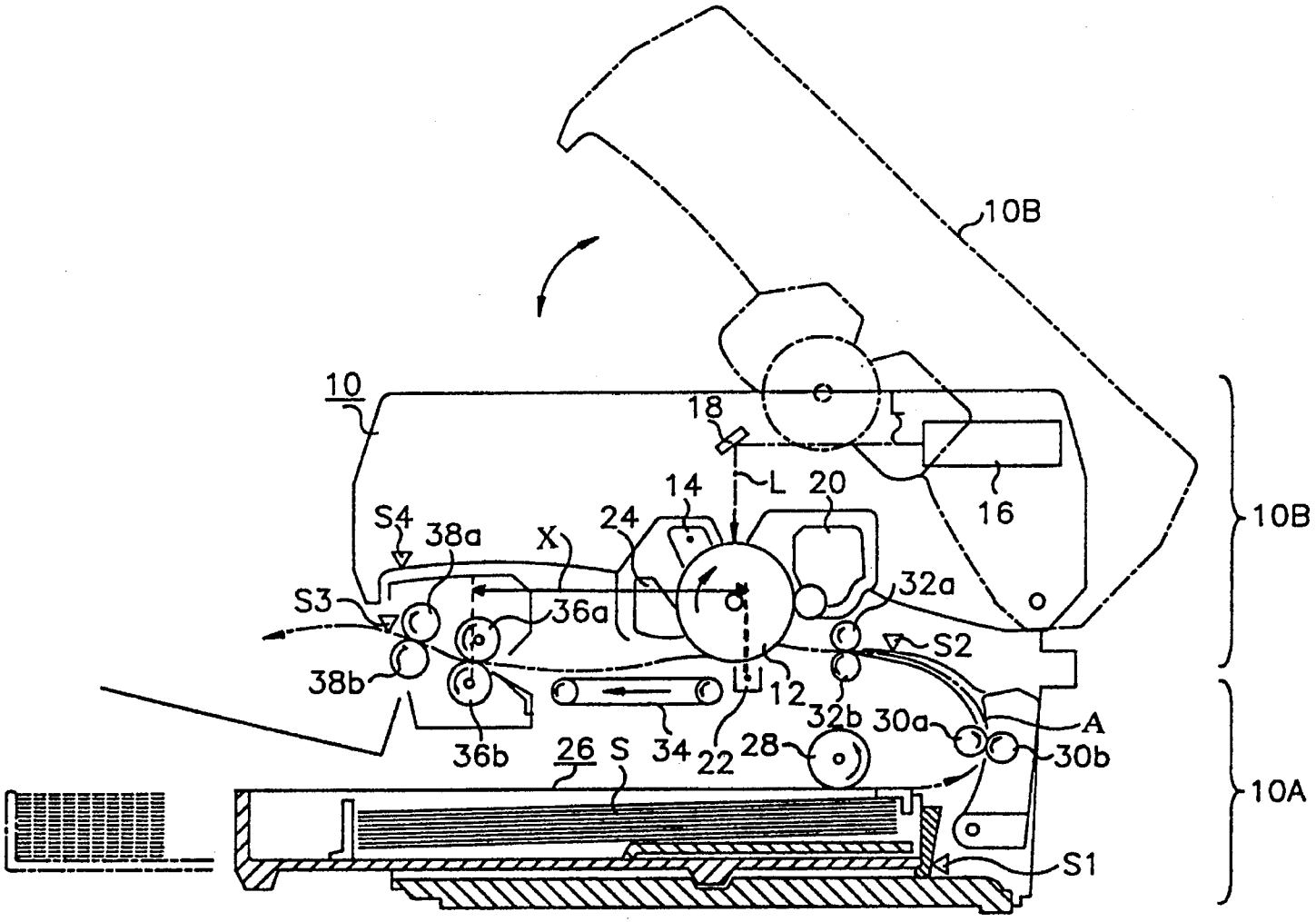
FIG. 1 is a side view of a printer using an electrophotographic developing system.

Turning now to the drawings, the printer shown in FIG. 1 includes a housing 10 having a body 10A and a cover 10B. Cover 10B is pivotally mounted on body 10A and can be rotatably opened or closed relative to body 10A. A charger 14 forms a uniform charge on a photosensitive drum 12. A laser scanner unit 16 generates laser beam L corresponding to image data to expose photosensitive drum 12 through a laser reflecting mirror 18, thereby forming an electrostatic latent image on an outer surface of photosensitive drum 12. A developing unit 20 transmits developing material, such as toner, to the electrostatic latent image formed on photosensitive drum 12. A pick-up roller 28 (also known as a feed roller) picks up and feeds paper S stacked in a paper cassette 26. Feeding rollers 30*a* and 30*b* feed paper fed by pick-up roller 28 to register rollers 32*a* and 32*b*. Register rollers 32*a* and 32*b* arrange the paper fed by pick-up roller 28 and feeding rollers 30*a* and 30*b*. A transfer unit 22 transfers developing material (i.e. toner) formed on photosensitive drum 12, onto the paper. A cleaner 24 removes residual toner from the surface of photosensitive drum 12 after the transfer of toner. A conveyor belt 34 then feeds the paper from transfer unit 22 to fixing rollers 36*a* and 36*b*. Fixing rollers 36*a* and 36*b* subsequently affix toner onto the paper. Fixing rollers 36*a* and 36*b* are heated by a heating lamp (not shown in FIG. 1) installed on the inside of the printer, to enable fixation of toner onto the paper. Delivery rollers 38*a* and 38*b* ultimately eject the image-formed paper to the exterior of the printer.

In a typical printer, sensors for determining the operational state of each portion of the printer and the conveyance state of the paper, are installed. FIG. 1 shows sensors S1–S4 for performing such functions. A first sensor S1, installed to contact a front end of paper cassette 26 on the inside of body 10A, senses the removal and insertion of paper cassette 26. A second sensor S2, installed in a paper conveyance path between feeding rollers 30*a* and 30*b* and register rollers 32*a* and 32*b*, senses the conveyance state of paper between feeding rollers 30*a* and 30*b* and register rollers 32*a* and 32*b*. A third sensor S3, installed in a paper delivery path extending from delivery rollers 38*a* and 38*b*, senses the delivery of paper. A fourth sensor S4, installed on one side of cover 10B opposite body 10A, senses the opening and closing of cover 10B.

Figure 2:
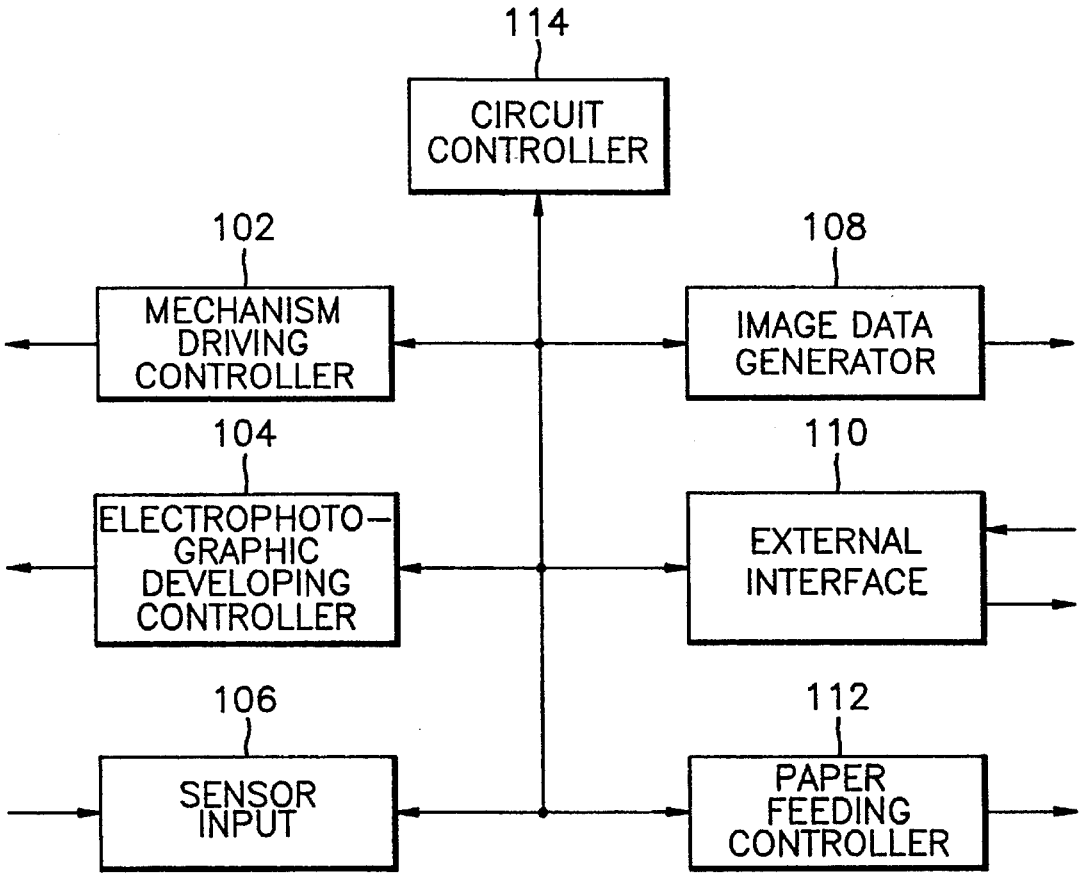
FIG. 2 is a block diagram of an engine control circuit used in a electrophotographic developing system.

FIG. 2 shows a block diagram of a control circuit for controlling an engine of the printer of FIG. 1. The control circuit is disclosed in Korean Patent application No. 92-11243 and in copending U.S. patent application for Method and Apparatus For Controlling a Print Engine of a Page Printer filed on 28 Jun. 1993 and assigned Ser. No. 08/082,917, assigned to the same assignee as the present invention and which is incorporated by reference into this application. A mechanism driving controller 102 controls the driving of mechanism parts, including the various rollers shown in FIG. 1. An electrophotographic developing controller 104 controls the development of an electrophotograph. A sensor input 106 receives outputs from various sensors, including sensors S1–S4 of FIG. 1, and then applies the outputs to a circuit controller 114. An image data generator 108 generates image data and transmits the image data to laser scanner unit 16. An external interface 110 interfaces signals received from an external control system (not shown) and generated thereto. A paper feeding controller 112 controls the feed of paper. Circuit controller 114 carries out various functions of the printer by controlling each portion of the printer, including mechanism driving controller 102, electrophotograph developing controller 104, image data generator 108, external interface 110 and paper feeding controller 112 in response to input signals from sensor input 106 and external interface 110. Typically, circuit controller 114, uses a microcomputer and implements an internal program to control each portion of the printer, thereby performing various functions of the printer.

A brief description of a printing process useful in understanding the present invention will now be given with reference to FIGS. 1 and 2.

When the circuit of FIG. 2 begins operation, circuit controller 114 controls electrophotographic developing controller 104 to activate the printer to a printing state and to establish a stand-by mode for determining whether or not a print command is received from the control system through external interface 110. During the stand-by mode, circuit controller 114 begins the printing operation in response to the print command. Circuit controller 114 sequentially operates photosensitive drum 12, charger 14, developing unit 20, transfer unit 22, laser scanner unit 16, and other components. Paper is then fed from paper cassette 26 to implement the printing operation. Paper fed by pick-up roller 28 from paper cassette 26 is arranged in register rollers 32*a* and 32*b*, after passing through feeding rollers 30*a* and 30*b* and second sensor S2. The arranged paper is then conveyed to transfer unit 22, and an image formed on photosensitive drum 12 is transferred onto the paper via toner. Thereafter, the paper is conveyed to fixing rollers 36*a* and 36*b* and the toner transferred onto the paper is affixed thereon by the heat of fixing rollers 36*a* and 36*b*. The paper is then delivered through delivery rollers 38*a* and 38*b* and third sensor S3. When the printing operation is terminated, circuit controller 114 stops operation of the respective parts of the printer's engine according to a predetermined sequence and again establishes the stand-by mode.

During the operations described above, there is an occasional mishap of paper becoming jammed within the printer. Such occurrences can be the result of poor paper condition or equipment malfunction. In either case, however, paper jams are both frustrating and inconvenient.

Typically, in the case of a paper jam, the printer automatically senses the paper jam through second and third sensors S2 and S3, and then informs a user of its occurrence. To automatically eliminate the paper jam, the user first activates an initial mode. The initial mode represents the printing state of the printer immediately after its power is switched on. Depending upon the printing system, the initial mode may be activated by either: opening and closing cover 10B, manually pressing a specific key on an operational panel of the printer, or switching the power supply off and, then switching the power on again. Conventionally, establishment of the initial mode results in elimination of the paper jam.

Figure 3:
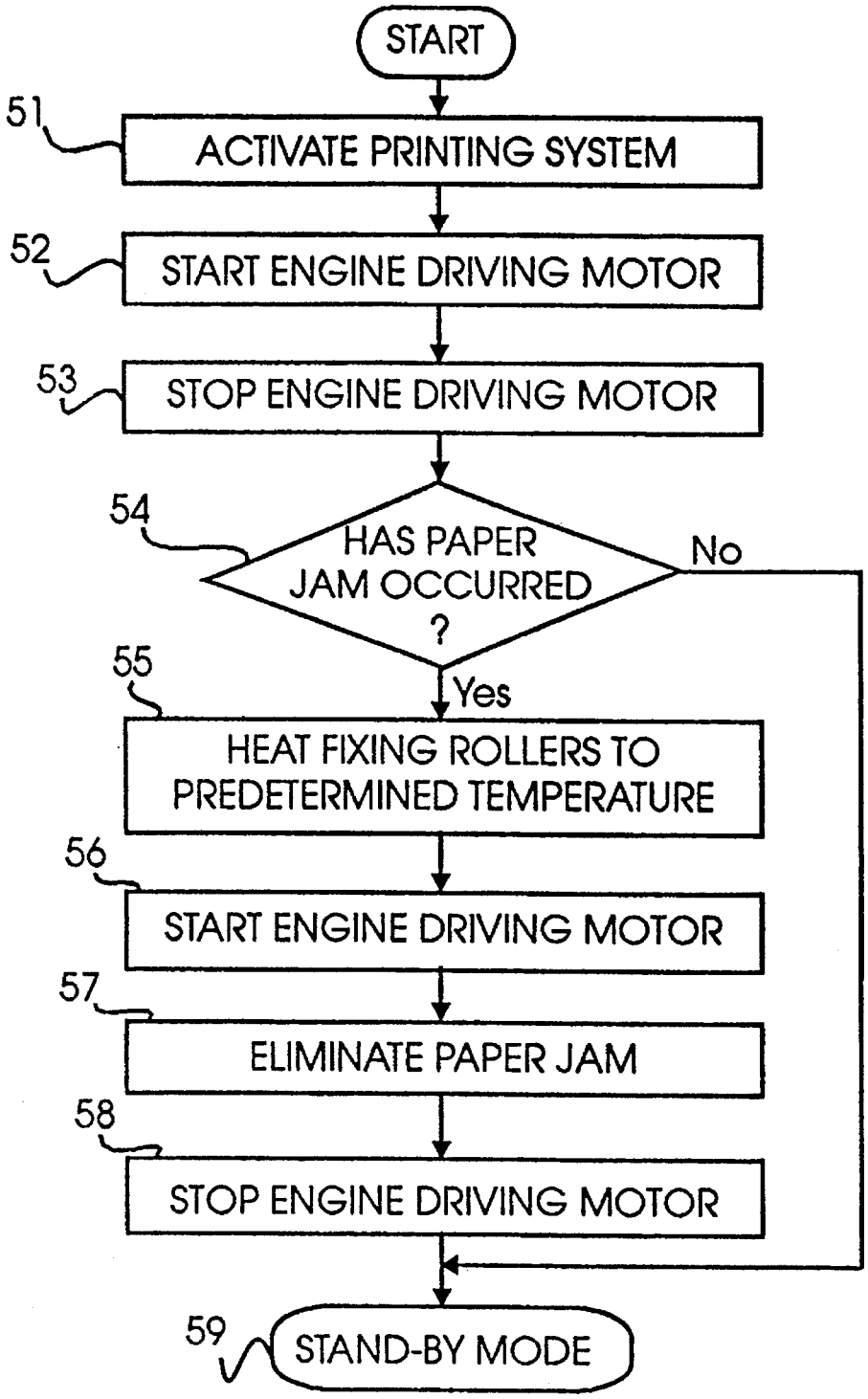
FIG. 3 PRIOR ART
FIG. 3 is a flow chart of an abstract simplification representing a conventional paper jam elimination operation.

Referring to FIGS. 1 through 3, a conventional method for eliminating a paper jam will now be described. In step 51, circuit controller 114 activates the printing system in response to establishment of the initial mode. Once the printing system is activated, the engine driving motor is started in step 52 in order to proceed to the stand-by mode. During this time, if paper is caught within the printer, it is ejected from the printer by operation of the engine driving motor. Thereafter, in step 53, operation of the engine driving motor is terminated. Then, after the engine driving motor is stopped, it is determined in step 54 whether a paper jam occurred while the engine driving motor was operating. To detect a potential paper jam, circuit controller 114 checks the states of second sensor S2 and third sensor S3. If either second sensor S2 or third sensor S3 is activated, circuit controller 114 concludes that a paper jam has occurred. If neither sensor is activated, circuit controller 114 concludes that a paper jam has not occurred, and thus the stand-by mode is established in step 59. If a paper jam has occurred, fixing rollers 36*a* and 36*b* are heated by the heat lamp, in step 55, to a predetermined temperature. The predetermined temperature is the same as the fixing temperature used in a typical printer. Fixing rollers 36*a* and 36*b* are heated in order to affix developing material (toner) onto the surface of the paper as the paper passes through the rollers. In step 56, circuit controller 114 again starts the engine driving motor so that the paper jam may be eliminated in step 57. Once the paper jam is eliminated, circuit controller 114 stops the engine driving motor in step 58 and proceeds to the stand-by mode in step 59.

I have observed that the conventional paper jam eliminating method described above, although operational, has a major problem associated with it. Since the engine driving motor is operated before a paper jam is checked for, developing material (toner) is not permanently affixed upon the paper. That is, if a paper jam occurs, toner is not fixed on the paper over a linear interval X extending between transfer unit 22 and fixing rollers 36*a* and 36*b* of FIG. 1 (i.e. toner has been applied, but is not yet fixed to the paper). Accordingly, a portion of the developing material (toner) remains on fixing rollers 36*a* and 36*b* and many of the engine parts located in the near vicinity. As a result of this left-over toner, stains begin to develop within the interior of the printer. These stains not only diminish the quality of printed images, but can also contribute to an unnecessarily shortened engine life.

The following description sets forth specific details to provide a more thorough understanding of the present invention. It will be apparent, however, to those skilled in the art, that the present invention may be practiced without these specific details. In these instances, well-known circuits have not been described in order to not obscure the present invention. The printer and engine control circuit shown in FIGS. 1 and 2, respectively, as well as the indicated reference numbers, apply to the present invention and will be referred to in the following description.

Figure 4:
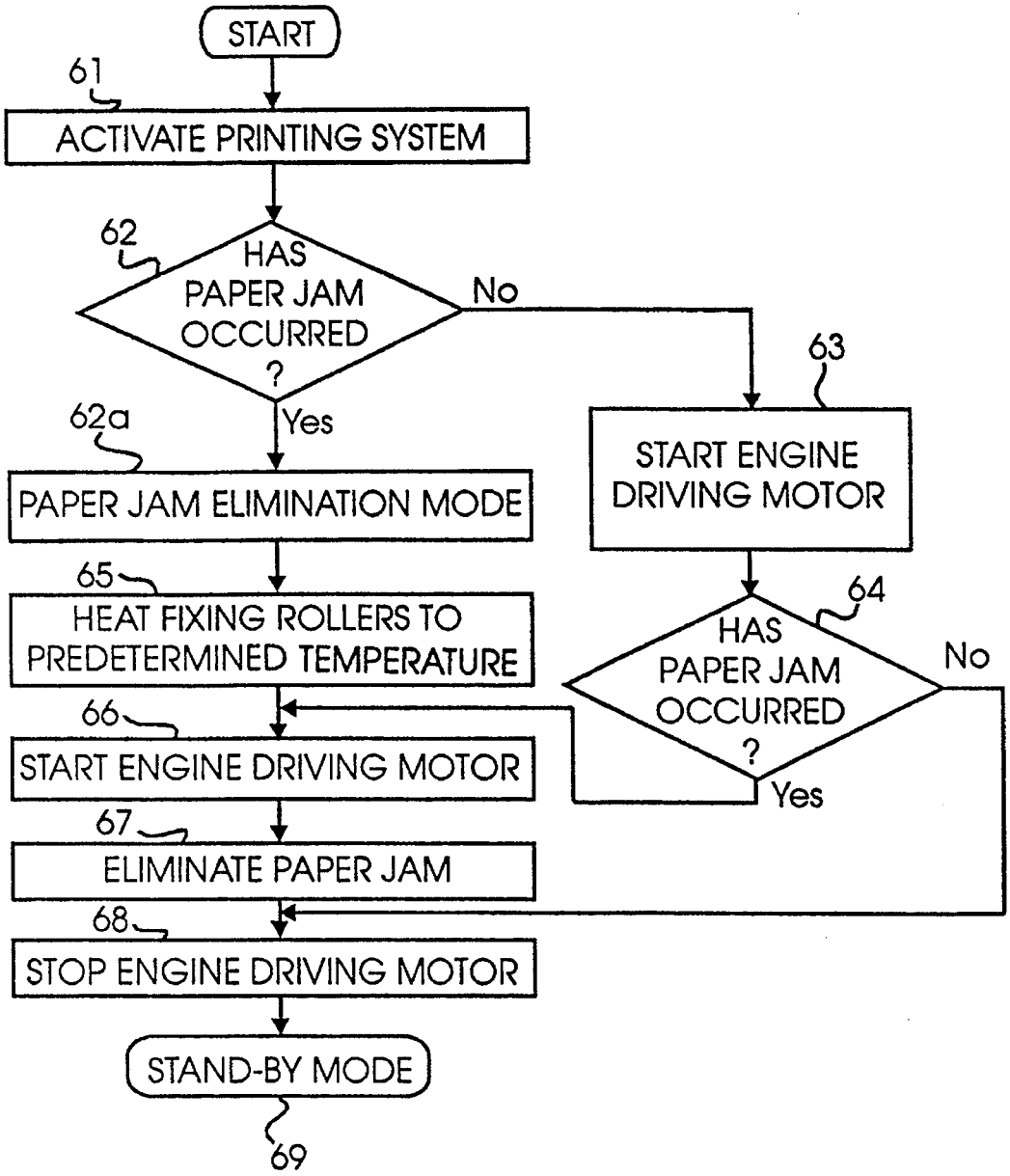
FIG. 4 is a flow chart of a paper jam elimination operation preferred according to the principles of the present invention.

FIG. 4 is a flow chart showing a method for eliminating a paper jam according to the principles of the present invention. In step 61, if power to the printer is turned "on" or if the initial mode of the printer is established, circuit controller 114 begins activation of the printing system. As mentioned above, the initial mode is typically established by either: opening and closing cover 10B, inputting a specific key on an operational panel of the printer, or switching the power supply off, then switching the power on again. In step 62, a first determination is made as to whether a paper jam has occurred. To make this determination, circuit controller 114 checks the states of second sensor S2 and third sensor S3. If either second sensor S2 or third sensor S3 is activated, circuit controller 114 concludes that a paper jam has occurred. Similarly, if neither sensor is activated, circuit controller 114 concludes that a paper jam has not occurred. If no paper jam has occurred, circuit controller 114 starts the engine driving motor in step 63 in order to proceed to the stand-by mode. If, however, a paper jam occurs in step 62, a paper jam elimination mode is established in step 62*a*. The paper jam elimination mode is typically established in a manner similar to the initial mode. Upon establishment of the paper jam elimination mode, fixing rollers 36*a* and 36*b* are heated by the heat lamp, in step 65, to a predetermined temperature. As stated earlier, fixing rollers 36*a* and 36*b* are heated in order to affix developing material (toner) onto the surface of the paper.

Next, in step 66, the engine driving motor is started, and in step 67, the paper jam is eliminated. Once the paper jam is eliminated, the engine driving motor terminates operation in step 68, and the stand-by mode is established in step 69. Therefore, since the paper jam elimination mode is established upon the occurrence of a paper jam, developing material (toner) can be fully transferred onto the surface of the paper because fixing rollers 36*a* and 36*b* are heated to the predetermined temperature before the passage of paper. As a result, detrimental amounts of toner do not remain on fixing rollers 36*a* and 36*b*, and the interior of the printer is free from toner stains.

If, however, a paper jam is not deemed to have occurred in step 62, operation of the engine driving motor begins in step 63. Next, in step 64, a second determination is made as to whether a paper jam has occurred. This is to detect whether the paper jam which is not sensed in step 62 has occurred. If a paper jam occurs such that the front end of the paper does not pass second sensor S2, (for instance, the front end of the paper is conveyed only to position A shown in FIG.1), the occurrence of the paper jam is not sensed in step 62, but the paper jam is sensed as the engine driving motor is driven in step 63. That is, since the paper is conveyed by feeding rollers 30*a* and 30*b* while driving the engine driving motor, the paper jam is sensed by second sensor S2 and third sensor S3. As described above, circuit controller 114 makes this determination by checking the states of second sensor S2 and third sensor S3. If either second sensor S2 or third sensor S3 is activated, circuit controller 114 concludes that a paper jam has occurred. Similarly, if neither sensor is activated, circuit controller 114 concludes that a paper jam has not occurred. If no paper jam has occurred, circuit controller 114 stops the engine driving motor in step 68, and then proceeds to the stand-by mode in step 69. If, however, a paper jam occurs in step 64, circuit controller 114 starts the engine driving motor in step 66 and enables elimination of the paper jam in step 67. Once the paper jam is eliminated, operation of the engine driving motor is terminated in step 68, and the stand-by mode is established in step 69. In steps 64 and 66–69 described above, no toner is transferred onto the paper as it passes through the printer. Therefore, even if the paper jam is eliminated without heating fixing rollers 36*a* and 36*b*, toner stains within the printer's interior do not occur.

In the present invention, since toner is either affixed to paper by fixing rollers 36*a* and 36*b* or not transferred to the paper at all, when a paper jam is eliminated, toner stains on interior portions of the printer are avoided. As a result, image reproduction quality and engine life of the printer can be maintained.

While a preferred embodiment has been described in the aforementioned description of the present invention, it is hereby acknowledged that various modifications can be made without deviating from the spirit and scope of the present invention. Specifically, the present invention provides a printing system that is activated by establishing an initial mode of operation. Then, when a paper jam occurs, it is quickly eliminated. Additionally, the present invention provides an immediate paper jam elimination operation which eliminates existing paper jams after heating fixing rollers 36*a* and 36*b*. The immediate paper jam elimination operation is performed in response to establishment of a paper jam elimination mode. The paper jam elimination mode is generally established in a manner similar to the initial mode. Although the previous description has been applied to a laser beam printer, the present invention may also be applied to all image forming systems of the electrophotographic developing type. Accordingly, the scope of the present invention is determined not only by the aforementioned embodiment, but by the following claims and their equivalence.

What is claimed is:

1. A method for eliminating a jam of a printable medium in an image forming system having means for providing conveyance of the printable medium through the image forming system and for fixing developing material onto the printable medium, said method comprising the steps of:

activating the image forming system;

making a first determination of whether the jam of the printable medium has occurred after the image forming system is activated without activating said means for providing conveyance of the printable medium;

establishing a jam elimination mode when said first determination indicates occurrence of the jam during said conveyance of the printable medium through the image forming system, said jam elimination mode being established in order to eject the printable medium from the image forming system;

heating said fixing means to a predetermined temperature in response to establishment of said jam elimination mode; and eliminating the jam of the printable medium after said step of heating said fixing means to said predetermined temperature by driving the conveyance providing means to transport the printable medium from the image forming system during said jam elimination mode.

2. The method as claimed in claim 1, further comprising the steps of:

when said first determination indicates that the jam of the printable medium has not occurred, driving said means for providing conveyance of the printable medium and then making a second determination of whether the jam of the printable medium has occurred; and when said second determination indicates that the jam of the printable medium has occurred, eliminating the jam of the printable medium by driving said means for providing conveyance of the printable medium to transport the printable medium from the image forming system without transferring developing material onto the printable medium.

3. A method for eliminating a jam of a printable medium in an image forming system comprising means for providing conveyance of the printable medium through the image forming system and means for fixing and permanently securing developing material onto the printable medium as the printable medium passes through said fixing means, said method comprising the steps of:

activating the image forming system in response to establishment of an initial system mode;

making a first determination of whether said jam impeding said conveyance of the printable medium through the image forming system has occurred immediately after said establishment of said initial system mode;

heating said fixing means to an elevated temperature when said first determination indicates that the jam of the printable medium has occurred; and eliminating said jam of the printable medium after heating said fixing means to said elevated temperature by driving the conveyance providing means to transport printable medium through the image forming system.

4. The method of claim 3, further comprising:

driving said conveyance providing means after determining during said first determination that no paper jam has occurred; and making a second determination of whether a paper jam has occurred after said driving said conveyance providing means.

5. The method as claimed in claim 4, further comprised of eliminating the jam of the printable medium without transferring said developing material onto the printable medium when said second determination indicates that the jam of the printable medium has occurred.

6. The method of claim 3, further comprised of setting said elevated temperature to permanently secure said developing material upon the printable medium as the printable medium passes through said fixing means.

7. The method as claimed in claim 3, wherein said initial system mode is selectively established by one of opening and closing a cover of said system manually, inputting a predetermined key entry from an operational panel of said system, and switching a system power supply off then switching the system power supply on.

8. A method for eliminating a paper jam from an image forming system having fixing rollers for permanently securing developing material upon a surface of a printable medium as the printable medium passes through said fixing rollers, said method comprising the steps of:

activating said image forming system by establishing an initial system mode;

making a first determination of whether a paper jam impeding transportation of the printable medium through an interior of said image forming system has occurred;

establishing a mode for elimination of the paper jam when said first determination indicates that the paper jam has occurred;

heating said fixing rollers to an elevated temperature in response to establishment of said paper jam elimination mode;

starting an engine driving motor providing kinetic energy for said transportation of the printable medium through the image forming system after said heating of said fixing rollers to said elevated temperature;

eliminating the paper jam detected during said first determination by providing said transportation of the printable medium through said fixing rollers, stopping said engine driving motor and placing the image forming system in a stand-by mode;

starting said engine driving motor when said first determination indicates that the paper jam has not occurred;

making a second determination of whether the paper jam has occurred after starting said engine driving motor when said first determination indicates that the paper jam has not occurred;

eliminating the paper jam detected during said second determination by providing said transportation of the printable medium through said fixing rollers, stopping said engine driving motor and placing the image forming system in said stand-by mode when said second determination indicates that the paper jam has occurred; and placing the image forming system in said stand-by mode when said second determination indicates that the paper jam has not occurred.

9. The method for eliminating the paper jam as claimed in claim 8, further comprised of setting said elevated temperature to permanently secure said developing material upon the printable medium as the printable medium passes through said fixing rollers.

10. The method for eliminating the paper jam as claimed in claim 9, wherein said initial system mode is established by one of opening and closing a cover of said image forming system, inputting a predetermined key entry from an operational panel of said image forming system, switching a system power supply off then on.

11. The method for eliminating the paper jam as claimed in claim 8, wherein said initial system mode is selectively established by one of opening and closing a cover of said system, manually inputting a predetermined key signal from an operational panel of said system, and switching a system power supply off then switching the power supply on.

12. An apparatus for eliminating a printable medium in a jammed state from an image forming system, comprising:

means for providing conveyance of a printable medium through a conveyance path within said image forming system;

sensing means for detecting a presence of the printable medium within said conveyance path of said image forming system;

fixing means for permanently fixing developing material onto the printable medium; and circuit controller means for sequentially activating said image forming system and making a first determination of whether said jammed state of the printable medium exists by checking states of said sensing means, said circuit controller means then establishing a jam elimination mode, heating said fixing means to a predetermined temperature and enabling elimination of said jammed state by causing said conveyance providing means to expel the printable medium from said image forming system when said first determination indicates that said jammed state of the printable medium exists.

13. The apparatus as claimed in claim 12, further comprised of said circuit controller means for sequentially activating said conveyance providing means and making a second determination of whether the jam of the printable medium has occurred when said first determination indicates that the jam of the printable medium has not occurred.

14. The apparatus as claimed in claim 13, further comprised of said circuit controller means for enabling elimination of said jammed state of the printable medium by causing said conveyance providing means to expel the printable medium from said image forming system without transferring said developing material onto the printable medium when said second determination indicates that said jammed state of the printable medium exists.

15. The apparatus as claimed in claim 12, further comprised of said circuit controller means for activating said image forming system in response to one of opening and closing a cover of said image forming system, input of a predetermined key entry from an operational panel of said image forming system, and switching a system power supply off then switching the system power supply on.

16. The apparatus as claimed in claim 15, further comprised of said sensing means comprising a detector for detecting said opening and closing of said cover of said image forming system.

17. The apparatus as claimed in claim 12, further comprised of said conveyance providing means comprising:

pick-up means for extracting the printable medium from within a cassette;

registration means for arranging the printable medium after the printable medium has been extracted from said cassette; and delivery means for ejecting the printable medium from said image forming system after said fixing means has permanently affixed the developing material onto the printable medium.

18. The apparatus as claimed in claim 17, further comprising a mechanism driving controller for controlling operation of said conveyance providing means in dependence upon an internal program stored in said circuit controller means.

19. The apparatus as claimed in claim 17, further comprising a paper feeding controller for controlling said pick-up means to extract the printable medium from within said cassette in dependence upon an internal program stored in said circuit controller means.

20. The apparatus as claimed in claim 12, further comprising sensor input means for receiving outputs from said sensing means and providing said outputs to said circuit controller means.

21. A method for eliminating a jam of a printable medium in an image forming system having means for providing conveyance of the printable medium through the image forming system and for fixing developing material onto the printable medium, said method comprising the steps of:

making a first determination of whether the jam of the printable medium has occurred;

establishing a jam elimination mode when said first determination indicates occurrence of the jam during said conveyance of the printable medium through the image forming system, said jam elimination mode being established in order to eject the printable medium from the image forming system;

heating said fixing means to a predetermined temperature in response to establishment of said jam elimination mode;

eliminating the jam of the printable medium after said step of heating said fixing means to said predetermined temperature by driving the conveyance providing means to transport the printable medium from the image forming system during said jam elimination mode;

when said first determination indicates that the jam of the printable medium has not occurred, driving said conveyance providing means and then making a second determination of whether the jam of the printable medium has occurred; and when said second determination indicates that the jam of the printable medium has occurred, eliminating the jam of the printable medium by driving said conveyance providing means to transport the printable medium from the image forming system without transferring the developing material onto the printable medium.

* * * * *